US006269557B1

(12) United States Patent
Henks

(10) Patent No.: US 6,269,557 B1
(45) Date of Patent: Aug. 7, 2001

(54) MANUALLY ADJUSTABLE SNOWPLOW APPARATUS

(76) Inventor: Phillip K. Henks, Rte. 1, Box 52, Carrollton, MO (US) 64633

( * ) Notice: Subject to any disclaimer, the term of this patent is extended or adjusted under 35 U.S.C. 154(b) by 0 days.

(21) Appl. No.: 09/455,081

(22) Filed: Dec. 6, 1999

(51) Int. Cl.[7] ..... E01H 5/04

(52) U.S. Cl. ..... 37/235; 172/817; 172/246; 172/247; 74/528

(58) Field of Search ..... 37/231, 232, 264, 37/266, 270, 271, 235, 241; 172/810, 811, 817, 828, 245, 246, 247, 250; 74/543, 544, 545, 547, 527, 528, 523

(56) References Cited

U.S. PATENT DOCUMENTS

| | | | | |
|---|---|---|---|---|
| 3,793,752 | * | 2/1974 | Snyder | 172/277 X |
| 3,987,562 | | 10/1976 | Deen et al. . | |
| 4,130,952 | * | 12/1978 | Dion | 172/245 X |
| 4,342,163 | | 8/1982 | Hoekstra . | |
| 4,470,211 | | 9/1984 | Rossmann . | |
| 4,571,861 | | 2/1986 | Klever et al. . | |
| 4,615,130 | | 10/1986 | Racicot . | |
| 4,754,562 | | 7/1988 | McGarrah et al. . | |
| 4,890,400 | * | 1/1990 | Long | 37/117.5 |
| 4,910,893 | * | 3/1990 | Asay | 37/281 |
| 4,976,053 | * | 12/1990 | Caley | 37/231 |
| 5,088,215 | * | 2/1992 | Ciula | 37/197 |
| 5,121,562 | | 6/1992 | Feller . | |
| 5,142,801 | | 9/1992 | Feller . | |
| 5,485,690 | * | 1/1996 | MacQueen | 37/231 |
| 5,509,219 | | 4/1996 | Mecca . | |
| 5,546,739 | * | 8/1996 | Hettich | 56/367 |
| 5,615,745 | * | 4/1997 | Cross | 172/811 |
| 5,706,990 | | 1/1998 | Laharson . | |
| 5,746,275 | * | 5/1998 | Cross et al. | 172/440 |
| 5,813,203 | * | 9/1998 | Peter | 56/17.2 |
| 5,967,241 | * | 10/1999 | Cross et al. | 172/811 |

* cited by examiner

*Primary Examiner*—Victor Batson
(74) *Attorney, Agent, or Firm*—Dale J. Ream

(57) ABSTRACT

A manually adjustable snowplow apparatus for mounting to an all terrain vehicle comprises a blade assembly pivotally mounted to a frame member of the ATV and adapted for relative up and down movement. The snowplow apparatus further includes a vertical plate mounted to the ATV and forming a plurality of spaced apart notches. A handle is pivotally attached to the plate and includes a rod that selectably mates with one of the notches. A cord extends between the handle and the blade assembly such that a forward or rearward movement of the handle decreases or increases, respectively, the height of the blade assembly above a ground surface.

13 Claims, 5 Drawing Sheets

MANUALLY ADJUSTABLE SNOWPLOW APPARATUS

BACKGROUND OF THE INVENTION

This invention relates generally to snow removal devices and, more particularly, to a manually adjustable snowplow apparatus that is mountable to an all terrain vehicle.

All terrain vehicles (ATV's), such as three-wheel or four-wheel vehicles with motorcycle engines, are being increasingly utilized for both recreational and utility purposes. ATV's are useful in farming to access locations not suitable for larger conventional vehicles and to transport small implements or materials. It has also been recognized, as in U.S. Pat. No. 4,615,130 to Racicot, that a snowplow may be attached to an ATV for clearing snow or other material such as sand, rocks, or the like. Although assumably effective in operation, existing snowplow devices adapted for use with an ATV are not easily adjustable such that the blade is a desired height above a ground surface. Further, existing devices are generally complex and expensive in construction and inconvenient to attach or remove from an ATV.

Therefore, it is desirable to have a snowplow apparatus that is simple and inexpensive to manufacture and easily mountable to an ATV. It is further desirable to have a snowplow apparatus which can be manually raised or lowered to a desired position by a user.

SUMMARY OF THE INVENTION

Accordingly, the adjustable snowplow apparatus according to the present invention utilizes a snow blade assembly pivotally mounted to the frame of an ATV such that the snow blade assembly extends in front of the ATV and is movable in up and down directions. The apparatus includes a vertical plate adapted to be mounted to the tubular utility rack typically found attached to the top surfaces of the front fenders of an ATV. The plate presents a hemispherical cutout which forms a plurality of notches along an upper edge thereof. A handle assembly is pivotally coupled to the plate, the handle assembly including a hollow cylindrical housing and an L-shaped rod. A first portion of the rod extends through the housing with a free end extending from an upper end of the housing. A second portion of the rod is normal to the first portion and selectably engages a notch in the plate. A user depression of the free end of the first rod portion releases the second portion from the notches such that the handle may be pivotally moved in a forward or rearward direction. The first portion of the rod is spring biased such that the rod automatically returns to its non-depressed position upon a release thereof. A release of the free end allows the second portion to again mate with a selected notch in the plate.

A cord extends between the handle assembly and the snow blade assembly such that a movement of the handle either raises or lowers the snow blade assembly. More particularly, the blade assembly is lowered as the handle is moved in a forward direction and is raised as the handle is moved in a rearward direction. A pulley is also mounted to the ATV utility rack for guiding the cord between the handle assembly and snow blade assembly. The apparatus can obviously be adapted for lifting implements other than snowplows.

Therefore, a general object of this invention is to provide a snowplow apparatus that is mountable to an all terrain vehicle.

Another object of this invention is to provide a snowplow apparatus, as aforesaid, which can selectably raise or lower a snow blade assembly to a desired height above a ground surface.

Still another object of this invention is to provide a snowplow apparatus, as aforesaid, having a handle for manually raising or lowering the blade assembly.

Yet another object of this invention is to provide a snowplow apparatus, as aforesaid, wherein the blade assembly is raised or lowered using the leverage of the handle coupled to a pivot axis.

A further object of this invention is to provide a snowplow apparatus, as aforesaid, which can hold the blade assembly at a plurality of different height positions.

A still further object of this invention is to provide a snowplow apparatus, as aforesaid, having a cord extending between the handle and blade assembly such that the height of the blade assembly is varied upon a movement of the handle.

Another object of this invention is to provide a snowplow apparatus, as aforesaid, having a pulley positioned intermediate the handle and blade assembly for guiding the cord therebetween.

Still another object of this invention is to provide a snowplow apparatus, as aforesaid, which is simple and inexpensive to use and manufacture.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

The preferred embodiment of the adjustable snowplow apparatus will now be described with reference to FIGS. 1–5 of the accompanying drawings.

Figure 1:
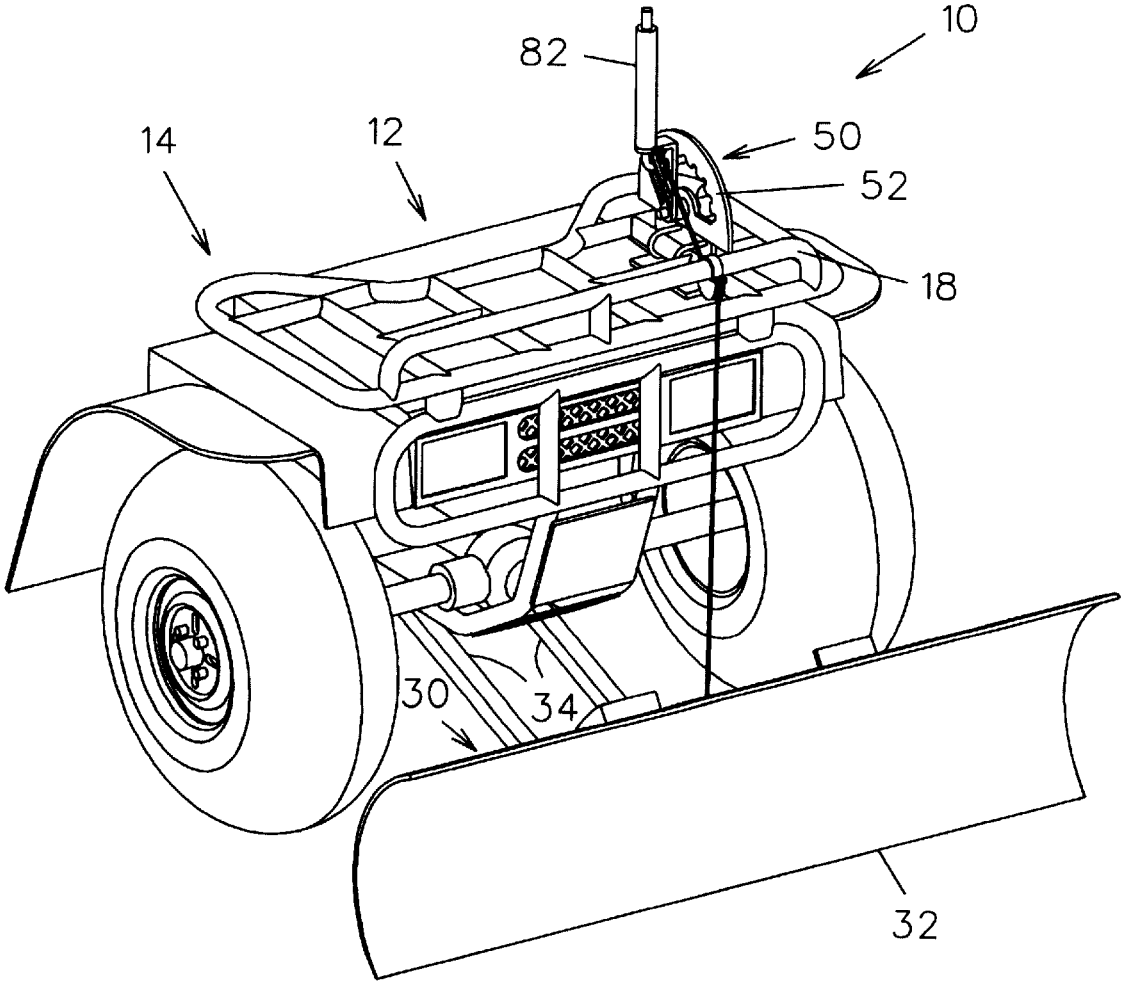
FIG. 1 is a perspective view of the adjustable snowplow apparatus mounted to the front of an all terrain vehicle according to the present invention.
Figure 5:
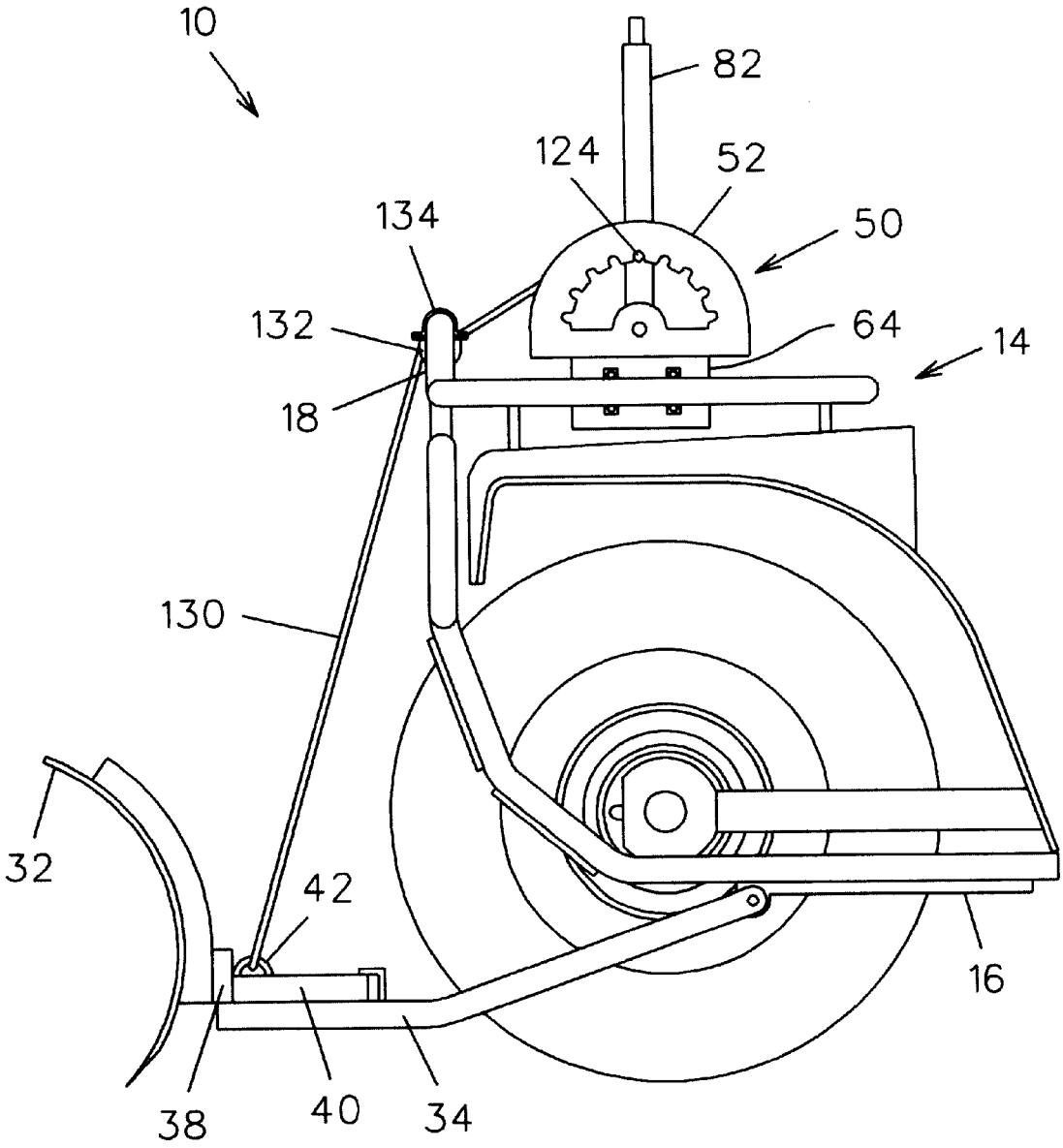
FIG. 5 is a side view of the apparatus as in FIG. 1 with a tire of the ATV removed.

The adjustable snowplow apparatus 10 according to the invention generally comprises a mounting assembly 50 and a snow blade assembly 30. As shown in FIGS. 1 and 5, the blade assembly 30 includes a snow removal blade 32 having a concave configuration. The blade assembly 30 further includes a pair of spaced apart support arms 34 which are fixedly attached to the blade 32 with a bracket 38 and extend rearwardly therefrom. A swivel mechanism 40 extends between the support arms 34 adjacent the bracket 38 such that the side-to-side angle of the blade 32 may be selectably adjusted by a user. Free ends 36 of the support arms 34 are pivotally coupled to a frame member 16 of an all terrain vehicle 12 (ATV) with bolts or other similar fasteners. The all terrain vehicle may be a three-wheel or four-wheel vehicle which utilizes a motorcycle engine. A pivot axis is defined by this point of attachment. A U-bolt 42, D-ring, or the like, may be attached to the swivel mechanism 40 for connection to a cable 130 as to be more fully described below.

Figure 2:
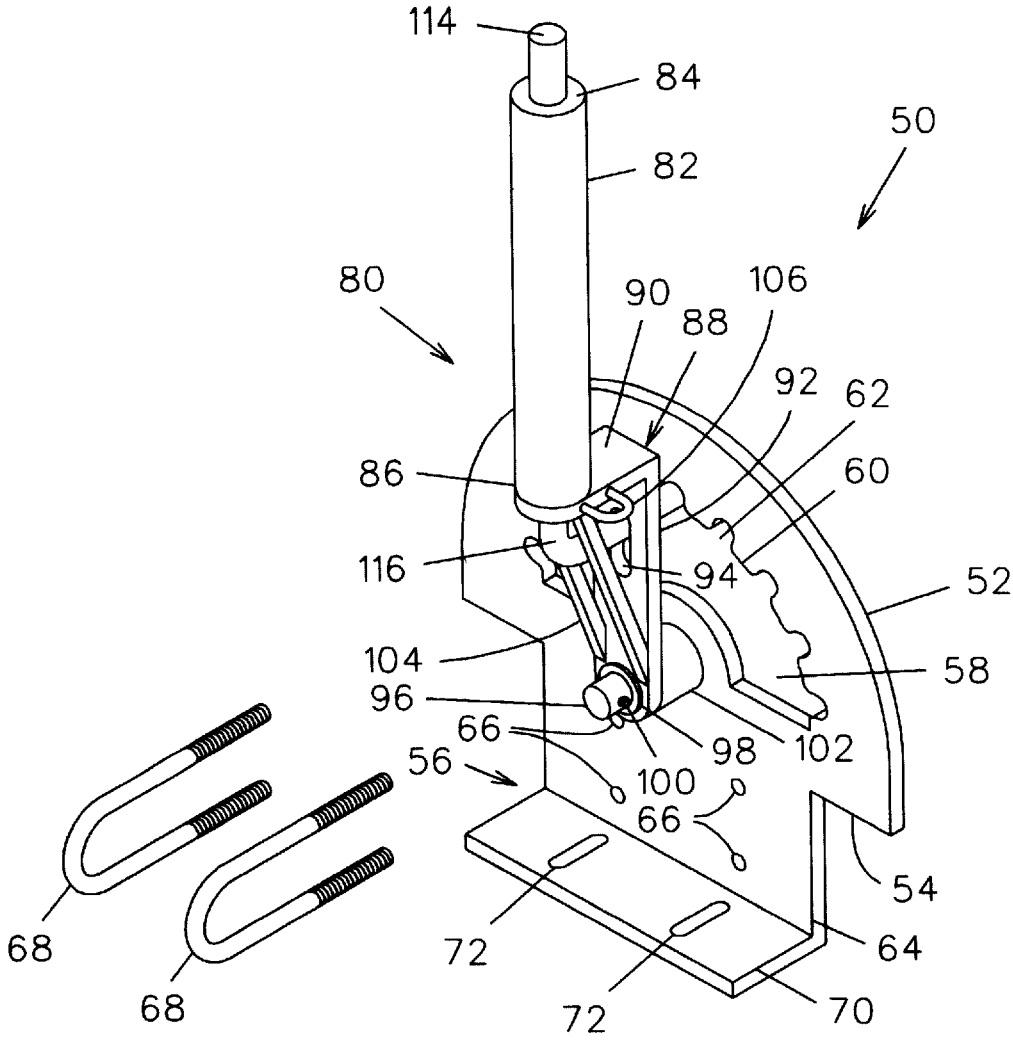
FIG. 2 is a perspective view of the mounting assembly on an enlarged scale.
Figure 3A:
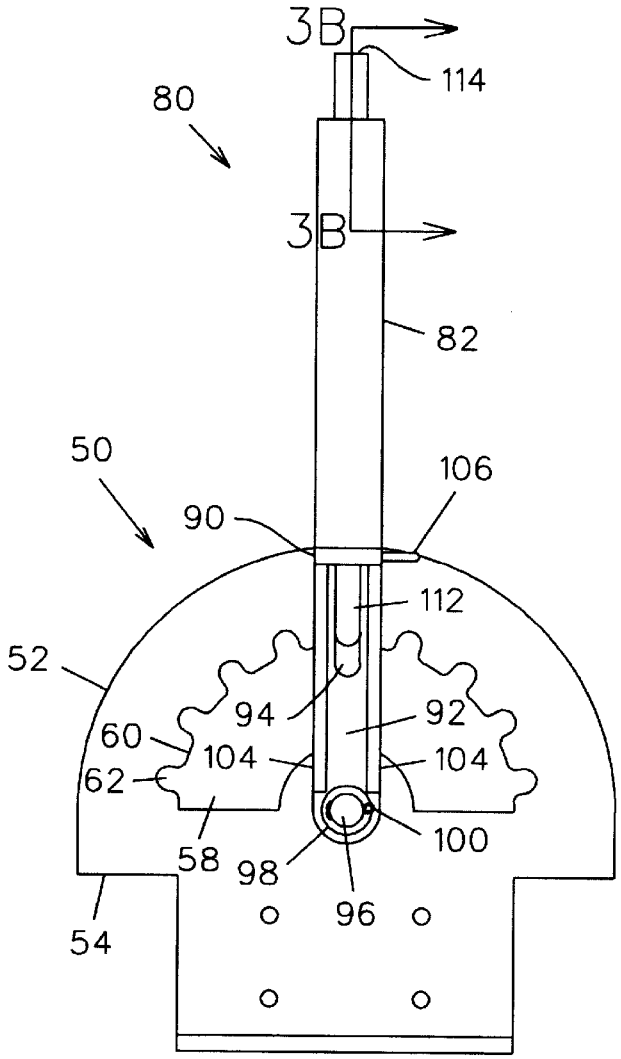
FIG. 3A is a side view of the mounting assembly of FIG. 2.
Figure 3B:
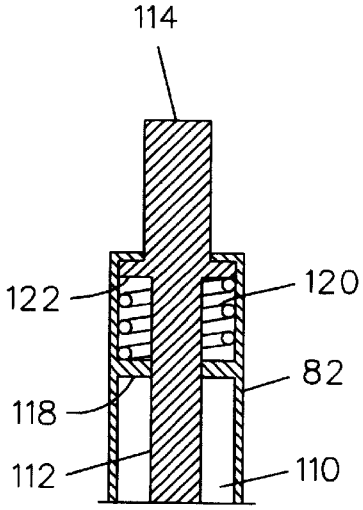
FIG. 3B is a sectional view of the handle assembly taken along line 3B—3B of FIG. 3A.
Figure 4:
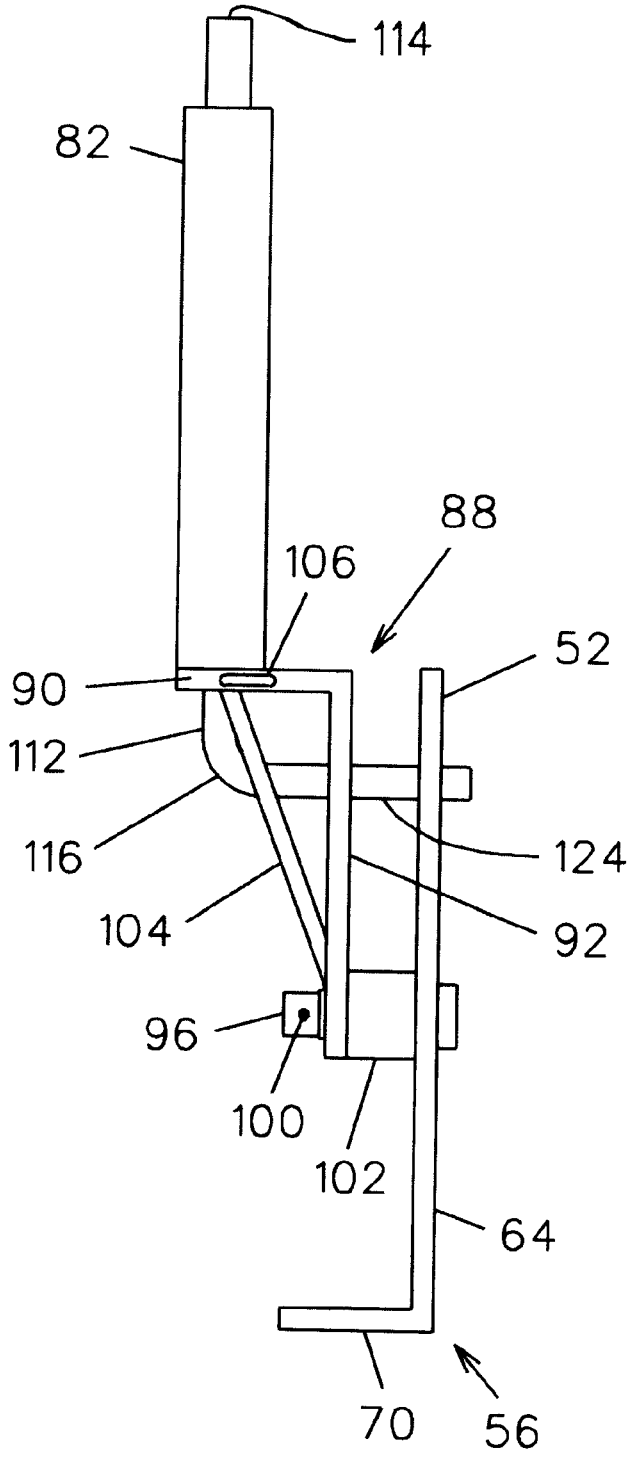
FIG. 4 is a front view of the mounting assembly of FIG. 2.

Turning to FIGS. 2 through 4, the mounting assembly 50 includes a mounting plate 52 having a hemispherical configuration and an L-shaped mounting bracket 56 integrally depending from a lower edge 54 thereof. The mounting plate 52 includes a hemispherical cutout 58 forming a plurality of notches 62 along an arcuate upper edge 60 thereof. The mounting bracket 56 comprises a first portion 64 depending from the lower edge 54 of the plate 52 and having a rectangular configuration. The first portion 64 includes two pair of circular apertures 66 for receiving U-bolts 68 when mounting the plate 52 to a tubular element of an ATV utility rack 14. It is understood that a tubular utility rack 14 is a standard feature on most ATV's and is usually fixedly attached to the upper surfaces of the front or rear fenders thereof. A second portion 70 of the mounting bracket 56 is normal to the first portion 64 and includes a pair of spaced apart slots 72 therein. Where a utility rack is not available, the mounting plate 52 may be mounted directly to the fender or hood of an ATV by inserting bolts through the slots 72.

The mounting assembly 50 further comprises a handle assembly 80 having a cylindrical handle 82 fixedly mounted atop a first portion 90 of a bracket 88. A second portion 92 of the bracket 88 depends from the first portion 90, the free end of which is pivotally coupled to a shaft 96. The shaft 96 extends through a spacer 102 and the plate 52, the spacer 102 being intermediate the plate 52 and second portion 92 of the bracket 88. The shaft 96, therefore, provides a pivot axis for the handle assembly 80. The free end of the second bracket portion 92 is securely coupled about the shaft 96 by a washer 98 and pin 100. The second bracket portion 92 also includes a slot 94 intermediate the free end thereof and the first bracket portion 90. A brace 104 extends between the first bracket portion 90 and the free end of the second portion 92. A D-ring 106 or similar attachment means extends from an edge of the first bracket portion 90.

A bore 110 extends between upper 84 and lower 86 ends of the handle 82. The handle assembly 80 includes an L-shaped rod extending through the bore 110 and into engagement with the notches 62 in the plate 52. More particularly, a first portion 112 of the rod extends through the bore 110. In a normal position, a free end 114 of the first rod portion 112 extends beyond the upper end 84 of the handle 82 while an opposed end 116 extends beyond the lower end 86 thereof. The handle 82 further includes a wall 118 mounted transversely within the bore 110 and displaced from the upper end 84, the wall 118 having an aperture through which the first rod portion 112 extends (FIG. 3B). The handle 82 includes a compression spring 120 between the wall 118 and upper end 84. The first rod portion 112 includes a circular flange 122 adjacent the upper end 84 within the handle bore 110. Thus, a depression of the free end 114 of the first rod portion 112 causes the spring 120 to be compressed or biased by the flange 122, a release of the free end 114 allowing the first rod portion 112 to spring back to its normal or unbiased position.

A second portion 124 of the rod is integrally attached to the opposed end 116 of the first rod portion 112 and normal thereto. The second rod portion 124 extends through the slot 72 in the second bracket portion 70 and through the cutout 58 in the plate 52. When the rod is in its normal position, the second rod portion 124 mates with a selected notch 62 in the plate 52. When the rod is moved to a biased or depressed position, the second rod portion 124 is released from the previous mating engagement and is free to be moved into engagement with a different notch according to movement of the handle 82 by a user.

A wire cable 130 is attached at one end to the D-ring 106 of the first bracket portion 64 and at an opposed end to the U-bolt 42 of the blade assembly 30. It is understood that the D-ring 106 and U-bolt 42 could be replaced with hooks or other types of rings or fasteners. A pulley 132 is coupled to a tubular element 18 of the utility rack 14 with a swivel sheave 134. The cable 130 passes through the pulley 132 to prevent the cable 130 from wearing grooves in the rack elements during use.

In use, the support arms 34 of the blade assembly are pivotally coupled to a frame member 16 of an ATV. The mounting assembly 50 is attached to the utility rack 14 by cradling a rack member 18 against the first 64 and second 70 portions of the mounting bracket 56 and securing the bracket thereto with U-bolts 68. Alternatively, the mounting bracket 56 can be bolted directly to the fenders of the ATV. The pulley 132 is mounted to a rack member 18 or may be mounted directly to the fender of the ATV. The height of the blade assembly 30 above the ground is increased by depressing the free end 114 of the first rod portion 112 of the handle 82 which releases the second rod portion 124 from a notch 62 and then moving the handle 82 in a rearward direction. A release of the free end 114 allows the second rod portion 124 to mate with a different notch to hold the blade assembly 30 at that position. The height of the blade assembly 30 is decreased in substantially the same manner except that the handle is moved in a forward direction rather than rearward.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An apparatus for mounting to a front end of an all terrain vehicle for supporting an implement at a desired height above a ground surface, said vehicle having a frame, comprising:

a framework pivotally coupled to said vehicle frame and adapted to support said implement, said framework adapted for up and down movement;

a vertical plate mounted to said front end of said vehicle, said plate defining a hemispherical cutout forming a plurality of spaced apart notches alone an upper edge thereof;

a handle pivotally mounted to said plate and movable between selectable forward and rearward positions, said handle including an L-shaped rod adapted to selectable mate with one of said notches in said plate upon a movement of said handle; and a cord having a first end coupled to said handle and a second end coupled to said implement, whereby a movement of said handle varies the relative up and down position of said implement.

2. An apparatus as in claim 1 further comprising a pulley adapted to be mounted on a front end of a vehicle for guiding a portion of said cord therealong upon a movement of said handle.

3. An apparatus as in claim 1 wherein said framework includes a pair of spaced apart arms having first ends adapted to be pivotally coupled to the vehicle frame and second ends attached to said implement.

4. A snowplow apparatus for mounting to an all terrain vehicle having a tubular utility rack, comprising:

a snow blade assembly pivotally mounted in front of said vehicle, said blade assembly adapted for up and down movement;

a vertical plate mounted to said rack and forming a plurality of spaced apart notches;

a handle pivotally mounted to said plate, said handle further comprising:

an elongate housing having upper and lower ends and a bore extending through said housing between said upper and lower ends;

an L-shaped rod having a first portion extending through said bore and a second portion normal to said first portion adapted to releasably mate with one of said notches of said plate, said rod movable between a first position wherein a free end of said rod extends above said upper end of said housing and said second portion mates with one of said notches in said plate and a second position wherein said free end of said rod is adjacent said upper end of said housing and said second portion is displaced from said notches;

a spring mounted in said bore adjacent said upper end of said housing for moving said rod from said second position to said first position; and a cord having a first end coupled to said handle and a second end coupled to said snow blade assembly, whereby a movement of said handle varies the relative up and down position of said blade assembly.

5. An apparatus as in claim 4 wherein said plate presents a hemispherical configuration having a hemispherical cutout therein, said notches being formed along an arcuate edge of said cutout.

6. An apparatus as in claim 4 further comprising a pulley adapted to be mounted to a rack for guiding a portion of said cord therealong upon a movement of said handle.

7. An apparatus as in claim 4 wherein said blade assembly comprises:

a blade adapted for snow removal; and a framework coupled to said blade, said framework including a pair of spaced apart arms having free ends adapted to be pivotally coupled to a frame of the vehicle.

8. An apparatus as in claim 6, wherein said plate includes an L-shaped bracket adapted to cradle a tubular element of the rack and having apertures positioned to receive U-bolts therethrough, whereby to releasably couple said plate to the rack.

9. In combination, a snow removal apparatus connected to an all terrain vehicle having a tubular utility rack mounted to a front fender of said vehicle, said vehicle including a frame, said snow removal apparatus comprising:

a snow blade assembly pivotally mounted to said vehicle frame for relative up and down movement, said blade assembly positioned in front of said vehicle;

an upstanding mounting plate releasably coupled to said rack, said plate having a plurality of spaced apart notches;

a handle assembly pivotally coupled to said plate, said handle assembly comprising:

an elongate housing having upper and lower ends and a bore extending through said housing between said upper and lower ends;

an L-shaped rod having a first portion extending through said bore and a second portion normal to said first portion adapted to selectably mate with one of said notches of said plate, said rod movable between a first position wherein a free end of said rod extends above said upper end of said housing and said second portion mates with one of said notches in said plate and a second position wherein said free end of said rod is adjacent said upper end of said housing and said second portion is displaced from said notches; and a spring mounted in said bore adjacent said upper end of said housing for moving said rod from said second position to said first position; and a cord having a first end coupled to said handle and a second end coupled to said snow blade assembly, whereby a movement of said handle varies a relative up and down position of said blade assembly.

10. An apparatus as in claim 9 wherein said plate presents a hemispherical configuration having a hemispherical cutout therein, said notches being formed along an upper edge of said cutout.

11. An apparatus as in claim 9 further comprising a pulley mounted to said rack for guiding a portion of said cord therealong upon a movement of said handle.

12. An apparatus as in claim 9 wherein said blade assembly comprises:

a blade adapted for snow removal; and a framework coupled to said blade, said framework including a pair of spaced apart arms having free ends pivotally coupled to said vehicle frame.

13. An apparatus as in claim 9 wherein said plate includes an L-shaped bracket that cradles a tubular element of said rack and has at least one pair of apertures positioned to receive U-bolts therethrough, whereby to releasably couple said plate to said rack.

* * * * *